US009368313B1

(12) United States Patent
McGuire

(10) Patent No.: US 9,368,313 B1
(45) Date of Patent: Jun. 14, 2016

(54) ELECTRONIC AMPLIFIER DEVICE

(71) Applicant: INTERNATIONAL TECHNOLOGY CENTER, Raleigh, NC (US)

(72) Inventor: Gary Elder McGuire, Chapel Hill, NC (US)

(73) Assignee: International Technology Center, Raleigh, NC (US)

( * ) Notice: Subject to any disclaimer, the term of this patent is extended or adjusted under 35 U.S.C. 154(b) by 234 days.

(21) Appl. No.: 13/909,206

(22) Filed: Jun. 4, 2013

Related U.S. Application Data

(60) Provisional application No. 61/656,115, filed on Jun. 6, 2012.

(51) Int. Cl.

| | |
|---|---|
| ***H01P 1/185*** | (2006.01) |
| ***H01J 23/24*** | (2006.01) |
| ***H01J 23/027*** | (2006.01) |
| ***H01J 23/08*** | (2006.01) |

(52) U.S. Cl.
CPC ..... *H01J 23/24* (2013.01); *H01J 23/027* (2013.01); *H01J 23/08* (2013.01)

(58) Field of Classification Search
CPC ..... H01J 23/27
USPC ..... 315/35–26, 35–39; 333/162, 3.5, 157, 333/253, 101, 99 PL
See application file for complete search history.

(56) References Cited

U.S. PATENT DOCUMENTS

| | | | | |
|---|---|---|---|---|
| 3,387,169 | A | 6/1968 | Farney | |
| 3,916,246 | A * | 10/1975 | Preist | 315/5 |
| 4,820,688 | A * | 4/1989 | Jasper, Jr. | 505/200 |
| 4,912,367 | A | 3/1990 | Schumacher et al. | |
| 5,082,517 | A * | 1/1992 | Moslehi | H01J 37/32266 118/723 E |
| 5,668,442 | A * | 9/1997 | Goebel et al. | 315/39 |
| 6,950,590 | B2 | 9/2005 | Cheung et al. | |
| 7,615,931 | B2 | 11/2009 | Hooke et al. | |
| 7,615,933 | B2 | 11/2009 | Hooke et al. | |
| 8,084,947 | B2 | 12/2011 | Hooke et al. | |

(Continued)

FOREIGN PATENT DOCUMENTS

| | | |
|---|---|---|
| WO | WO 2012/170534 | 12/2012 |

OTHER PUBLICATIONS

Goebel, Dan M. et al., "High current, low pressure plasma cathode electron gun", Review of Scientific Instruments, vol. 71 No. 2, pp. 388-398, Feb. 2000.

(Continued)

*Primary Examiner* — Dinh T Le

(74) *Attorney, Agent, or Firm* — Miller Patent Services; Jerry A. Miller

(57) ABSTRACT

An integrated pressurized electronic power amplifier circuit including a plasma cathode structure and beam focusing approach leading to an electron beam, an interaction region; an input signal line for conducting an input signal into the interaction region; an output signal line for conducting an output signal from the interaction region; a collector for the electron beam; and an envelope for maintaining a pressurized ambient and a substrate for selected spatial alignment and thermal management; and wherein the plasma cathode structure generates a plasma as a source of electrons. This abstract is not to be considered limiting, since other embodiments may deviate from the features described in this abstract.

24 Claims, 5 Drawing Sheets

(56) References Cited

U.S. PATENT DOCUMENTS

| | | | |
|---|---|---|---|
| 8,264,300 | B2 | 9/2012 | Cisco |
| 8,344,627 | B1 | 1/2013 | Hooke et al. |

OTHER PUBLICATIONS

Goebel,Dan M. et al., "Advances in plasma-filled microwave sources", Physics of Plasmas, vol. 6 No. 5, pp. 2225-2232, May 1999.
Park, Jaeyoung et al.,"Gas breakdown in an atmospheric pressure radio-frequency capacitive plasma source", Journal of Applied Physics, vol. 89 No. 1, pp. 15-19, Jan. 2001.
Massines, Francoise et al., "Atmospheric Pressure Low Temperature Direct Plasma Technology: Status and Challenges for Thin Film Deposition", Plasma Processes and Polymers, vol. 9, pp. 1041-1073, 2012.
Bárdos, L. et al., "Cold atmospheric plasma: Sources, processes, and applications", Thin Solid Films 518 pp. 6705-6713, 2010.
Kogelschatz, Ulrich, "Filamentary, Patterned, and Diffuse Barrier Discharges", IEEE Transactions on Plasma Science, vol. 30, No. 4 pp. 1400-1408, 2002.
Shao, Tao et al.,"Excitation of Atmospheric Pressure Uniform Dielectric Barrier Discharge Using Repetitive Unipolar Nanosecond-pulse Generator", IEEE Transactions on Dielectrics and Electrical Insultation, vol. 17 No. 6, pp. 1830-1837, Dec. 2010.
Liu, D. W. et al., "Electron trapping in radio-frequency atmospheric-pressureglow discharges", Applied Physics Letters 90, pp. 041502-1-041502-3, 2007.
Vanke, V A, "Transverse electron-beam waves for microwave electronics", Physics—Uspekhi 48 (9), pp. 917-937, 2005.
Gilmour, Jr.; "Principles of Traveling Wave Tubes"; Artech House, Inc.; pp. 490, 526-530, 536-538; 1994.
Barker, Robert J., et al.; "Modern Microwave and Millimeter-Wave Power Electronics"; IEEE Press, Wiley-Interscience, John Wiley & Sons, Inc.; 364-365, 394-396; Apr. 2005.

* cited by examiner

ELECTRONIC AMPLIFIER DEVICE

CROSS REFERENCE TO RELATED DOCUMENTS

This application is related to and claims priority benefit of U.S. Provisional Patent Application No. 61/656,115 which is hereby incorporated by reference.

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

Vacuum electronic devices are often used in high power and high frequency applications such as a radar transmitter. In vacuum electronic devices the performance parameters tend to deteriorate over time. One mechanism for such performance degradation is deterioration of the cathode which may be associated with the high temperature of operation of thermally assisted cathodes or interaction of the cathode with gases present in the vacuum envelope. If air enters the vacuum envelope surrounding the beam stick as a result of leaks or adsorbed gases are released from the internal surfaces, especially during vacuum electronic device operation when some surfaces become hot, certain gases can react with the elements of the cathode. This degrades the performance of the cathode and the vacuum electronic device's electrical characteristics become irreversibly altered resulting in tube performance deterioration and eventual failure. Other mechanisms of degradation exist for thermal cathodes operating at high temperature. Both diffusion and evaporation contribute to changes in the cathode surface composition which influence cathode performance.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1A:
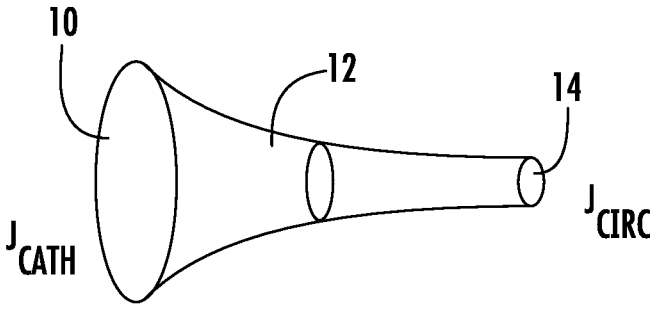
FIG. 1, which is made up of FIG. 1A and FIG. 1B, is a schematic illustration of compression of an electron beam consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment", "an example", "an implementation" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

The term "pressurized" as used herein in connection with embodiments consistent with the present invention is a relative term used to distinguish over pressures commonly used in vacuum electronic devices (vacuum tubes) which are often less than $10^{-7}$ Torr and including known amplifier devices which utilize a separate plasma cathode in which the inside of the vacuum tube envelope is evacuated to less than approximately $10^{-4}$ Torr (where 760 Torr=1 Atmosphere=atmospheric pressure). By contrast, embodiments consistent with the present invention generally require no such vacuum and may be operated at pressures up to and somewhat beyond atmospheric pressure. Above atmospheric pressure, it becomes increasingly difficult to generate a discharge. Even if a discharge is formed the degree of ionization will generally be less using known techniques and it is very likely to be significantly less. This would result in a dramatic reduction in the current density (electrons available) and the discharge will more likely be filamentary (regions where the electron current density is high but with a low average overall current density since the filaments are small localized regions). However, if these issues can be overcome, pressures in excess of one atmosphere could also be used. Hence, for purposes of this document, the pressures of interest generally range from about 100 Torr to a bit over one atmosphere, ±roughly 10-25% and in other cases range from about 500 Torr to a bit over one atmosphere ±roughly 10-25%. Pressures below approximately 50 Torr can potentially be used; however, the ions produced in the discharge become more energetic at lower pressures and may cause damage or erosion of the cathode.

The example integrated pressurized electronic power amplifier circuit device described below can be used for amplifiers, mixers, oscillators and other electronic devices based upon use of an amplifier device when configured in a conventional manner substituting the present amplifier structure for more conventional amplifier structures. The devices may be used in connection with electromagnetic radiation reception, generation and re-transmission, both tuned and broadband (by way of example). As used herein, the term "amplifier" may refer directly to amplifiers or to other circuit configurations utilizing the amplifying properties of the circuit including mixers or oscillators or the many variations of electronic devices historically served by vacuum electronic-based amplifiers. However, in examples consistent with the present teachings, the envelope surrounding the electronic device is pressurized as defined above instead of being evacuated to low pressure (high vacuum) and where the cathode is based upon electrons extracted from a plasma of the gas present in the pressurize envelope. Operation can be over a range of frequencies and powers including high-frequency and high-power as well as for microwave and lower millimeter-wave frequencies. Amplifiers that provide amplification in the upper millimeter-wave and into the terahertz spectral region can be generated. Applications of these devices include without limitation radio communications, telecommunications, radar, accelerators, spectroscopy, heating, power generation, electronic warfare and many other applications Pressurized electronic-based amplifiers consistent with the present teachings include a cathode as a source of electrons and beam focusing approach leading to an electron beam, an interaction structure, a collector (either single or multistage depressed collector) with a power recycling circuit to effectively recover spent beam energy and an output. Additional elements may include, for example, input and output waveguides, a first stage driver circuit, magnets and various mechanisms for thermal management.

The present structure should be contrasted with vacuum electronic devices such as vacuum tubes, in which a vacuum envelope surrounds the entire beam stick of the vacuum electronic device. This includes a structure for electron beam formation, beam transport and beam energy recovery. The high power levels achieved by vacuum electronic devices as compared to solid state semiconductor devices are the result of the fact that electrons can travel at a much higher velocity in a vacuum with much less energy loss than in a solid semiconductor material. The higher speed of electrons and longer path length in vacuum permits the use of larger structures than in semiconductor materials with more opportunity for interaction with the electromagnetic wave (radiation) passing from the input to the output of the interaction structure also referred to as the slow wave structure. A larger structure, in turn, permits a greater power output, often required for efficient operation. While semiconductor microwave amplifiers are available, they generally are unable to generate the power, bandwidth and tuning range capabilities achieved by most vacuum electronic-based amplifiers dictated by the properties of the semiconductor materials. In addition, semiconductor amplifiers are sensitive to radiation induced degradation.

In a forward-wave, traveling-wave tube amplifier designed to amplify a microwave signal, for example, the microwave signal to be amplified enters the tube near the electron gun and propagates along a slow-wave circuit. The tube delivers amplified microwave energy into an external matched load connected to the end of the circuit near the collector. Interaction between the electron beam and microwave radiation is continuous along the tube with contributions adding in phase. The slow-wave structure serves as an interaction structure to propagate the microwave radiation along the tube at approximately the same velocity as that of the electron beam. The RF energy causes the electron beam to bunch, which in turn amplifies the microwave signal traveling down the tube. These devices work in the density modulated mode, rather than the current modulated mode. This means that they work on the basis of bunches of electrons flying ballistically through the device, rather than using a continuous stream of electrons. To match the velocity of the electron beam with the velocity of the propagating RF wave an accelerating or extraction potential can be applied to the end of the beam at the collector. Charge repulsion between electrons will cause the electrons to accelerate along the direction of the accelerating or extraction potential.

Vacuum electronic devices typically operate by introducing a beam of electrons into a region where the beam interacts with an input signal, and applied electric and magnetic fields, and deriving an output signal from the thus-modulated beam. Vacuum electronic devices generally contain the basic components of a cathode structure, an electron beam, an interaction structure, and an output structure which may be arranged in various combinations to produce successive amplifications, frequency multipliers, transmit-receive amplifiers, crossbar switches, signal couplers, mixers, beam-formers, and selective polarization devices, among other such devices, the basic principles of which are described in the text by Robert J. Barker, John H. Booske, Neville C. Luhmann, Jr. and Gregory S. Nusinovich, Modern Microwave and Millimeter-Wave Power Electronics, IEEE Press, Piscataway, N. J., 2005.

Example devices include gridded tubes (e.g., triodes, tetrodes, pentodes, and klystrodes), klystrons, magnetrons, traveling wave tubes (including Helix and coupled cavity types), backward wave oscillators, crossed-field amplifiers and gyrotrons. The electromagnetic radiation may be extracted with an integrated antenna so that it propagates freely in open, unbounded space.

As used herein, the term "grid" indicates any structure that controls electron emission from the cathode, and the grid can have, for example, multiple apertures or a single aperture with geometries which may be circular or rectangular, or other variations which are described in Chapter 6 of the text A. S. Gilmour, Jr, Principles of Traveling Wave Tubes, Artech House, Boston, Mass., 1994. Pressurized electronic devices operate in an analogous manner by introducing a beam of electrons into a region where the beam interacts with an input signal, applied electric and magnetic fields, and deriving an output signal from the thus-modulated beam.

Pressurized electronic devices consistent with the present teachings generally include the basic components of a cathode structure, an electron beam, an input structure, an interaction structure, and an output structure which may be arranged in various combinations to produce successive amplifications, frequency multipliers, transmit-receive amplifiers, crossbar switches, signal coupler, mixers, beam-formers, and selective polarization devices, among other such devices. Example devices include gridded tubes (e.g., triodes, tetrodes, pentodes, and klystrodes), klystrons, traveling wave tubes (including Helix and coupled cavity types), magnetrons, backward wave oscillators, crossed-field amplifiers and gyrotrons. The electromagnetic radiation produced may be extracted with an integrated antenna so that it propagates freely in open, unbounded space.

In contrast to vacuum-based devices, pressurized electronic devices consistent with the present teachings have plasma cathodes that operate at comparatively high pressure. Electrons extracted from the plasma cathodes are accelerated between collisions with gas atoms or molecules even at pressures up to approximately atmospheric pressure at high electromagnetic potentials so that the electron beam has a path length and velocity which allows it to interact with the input signal which in turn amplifies the signal traveling along the interaction structure of the tube.

Vacuum electronic device performance parameters tend to deteriorate when measured over time periods of years. One mechanism for such performance degradation is deterioration of the cathode which may be associated with the high temperature of operation of thermally assisted cathodes or interaction of the cathode with gases present in the vacuum envelope. If air enters the vacuum envelope surrounding the beam stick as a result of leaks or adsorbed gases are released from the internal surfaces, especially during vacuum electronic device operation when some surfaces become hot, certain gases can react with the elements of the cathode. This degrades the performance of the cathode and the vacuum electronic device's electrical characteristics become irreversibly altered and are one cause of tube performance deterioration and eventual mortality. When tube vacuum is maintained at a high level, excellent performance and life is generally expected.

Vacuum electronic devices, also referred to as vacuum tubes, are enclosed within an envelope of glass, fused quartz, ceramic or metal which is chosen to retain a low pressure inside the envelope, generally of the order of $10^{-7}$ to $10^{-8}$ Torr, with the aid of getters provided to maintain a low partial pressure of reactive gases within the envelope once the tube is sealed for up to 15 years or more.

Extensive steps are taken to reduce the pressure inside the envelope in a vacuum tube before it is permanently sealed. This includes attaching the envelope to a pumping device to remove gases which are present to reach the desired pressure. Pumping is usually accompanied by radio frequency (RF) induction heating of the internal metal surfaces of the device to evolve adsorbed gases at temperatures compatible with the materials and components used in the construction of the device. To further reduce the presence of reactive gases which might degrade the cathode, vacuum tubes are constructed with "getters" which are often, by way of example, metals that oxidize quickly. One method of dispensing metal getters is by heating the getter material to a high temperature, again by RF induction heating for example, once the tube is sealed which causes the getter material to vaporize and deposit on the inside of the vacuum envelope. The getter reacts with certain gases which are residual within the vacuum envelope or which may enter the vacuum envelope as a result of vacuum leaks which may cause the device performance to deteriorate. Sufficient getter material is deposited to remain active for long periods of time.

The cathode has historically been the most sensitive component of a vacuum tube to the presence of reactive gases which are present as a result of poor vacuum or air leaks. Widely used cathodes such as thermionic cathodes operate at elevated temperatures sometimes around 1000° C. or more. At the high temperature of operation, thermionic cathodes react with certain gases if present in the vacuum envelope resulting in degradation of the cathode performance. Mechanical design and materials selection for mounting thermionic cathodes must take into consideration expansion due to thermal excursions from room temperature when the tube is off to the high operating temperature of the cathode when the tube is on. Field emission cathodes, so called cold cathodes, are an attractive alternative cathode technology since they operate at close to room temperature which simplifies the mechanical design for mounting the device. However like thermionic cathodes, field emission cathodes also operate best at high vacuum conditions and electron emission degrades as the pressure rises. The electron emission current from field emission cathodes may drop by more than 80% if the pressure rises to the level of $1\times10^{-5}$ Torr.

At the low pressure of a vacuum electronic device, electrons have a long mean free path and corresponding low probability of interacting with residual gases within the vacuum electronic device envelope. If the pressure rises, a situation which is considered unfavorable for vacuum electronic device operation and cathode lifetime, the probability for electron collisions with gases increases. However, at high electromagnetic fields, electrons are accelerated between collisions thus experiencing acceleration across the distance between the cathode and extraction grid or gun structure and between the electron gun and collector or between the cathode and collector even at pressures well above those of traditional vacuum electronic devices and even to about atmospheric pressure or more. This insight allows one to produce a traditionally vacuum electronic device but which is pressurized as defined above. The pressure may be from about 100 Torr up to about atmospheric pressure or slightly more than atmosphere pressure as discussed above. The pressurized electronic device forms the basis for a new class of fully-integrated amplifier structures that can be used, for example, for implementation of high power amplifiers.

Gas present in a pressurized electronic device allows the generation of a plasma, also known as a discharge or plasma discharge, which serves as the source of electrons, hereinafter "plasma cathode". The discharge resulting from the breakdown of the gas as a result of the application of an electromagnetic field above the gas breakdown potential also produces various ions, radicals and excited species in addition to electrons. Electrons acquire much higher kinetic energies than ions from the applied electromagnetic field due to the differences in their masses. Ions experience less acceleration between gas phase collisions than electrons also due to the differences in their masses. Thus, their mass and gas phase collisions contribute to the minimization of the kinetic energy of the ions thus reducing the potential for ion induced damage.

Due to the significantly different kinetic energies between the electrons and ions, the plasma is referred to as an energy non-equilibrium plasma. The plasma cathode as the source of electrons does not require high temperature and the associated high power for heating for operation and has no low work function surfaces which are sensitive to pressure. In contrast to thermionic cathodes, the plasma cathode structure is relatively simple since no heating structure is required and thus no corresponding demanding requirement to take into consideration the thermal expansion of the materials used to fabricate the cathode. In addition, collisions in the gas at elevated pressure are one mechanism to dissipate heat not available in vacuum tubes. Although as the power of operation increases, the discharge may cause a temperature rise of device structures in contact with the plasma and as a result the design takes into consideration thermal management. Discharge formation occurs over a broad gas temperature range so operation of the plasma cathode will continue under any temperature excursions resulting from device operation.

Like field emission cathodes, fast turn-on time is practical with plasma cathodes. Under the influence of controlling electric or magnetic fields, plasma cathodes can be implemented in a variety of pressurized electric amplifier geometries and configurations by those skilled in the art upon consideration of the present teachings for use in integrated pressurized electronic circuits and amplifiers.

Other types of plasma cathodes have been explored as sources of electrons for vacuum electron devices [Goebel, et al. "High current, low pressure plasma cathode electron gun", Rev. Sci. Instrum. 71, 388 (2000)]. However, all known previous approaches took extensive steps to maintain a low base pressure within the electron beam transport region of the tube (<about $10^{-5}$-$10^{-4}$ Torr), used puffs of gas to allow plasma generation while retaining a large pressure gradient between the electron gun and the microwave generation region or utilized differential pumping to ensure a low pressure within the envelope of the vacuum tube. The plasma generator reported by Goebel et al. used an additional oxide, Ba-dispensor or tungsten thermionic cathode to promote plasma formation also to be able to operate at a low pressure. So, plasma cathode generation was fundamentally very different and the cathode was not fully integrated into the envelope of the electronic device as in embodiments consistent with the present invention where the entire envelope is pressurized to as much as about atmospheric pressure and the plasma cathode is fully integrated into the integrated pressurized electronic amplifier device.

Figure 1B:
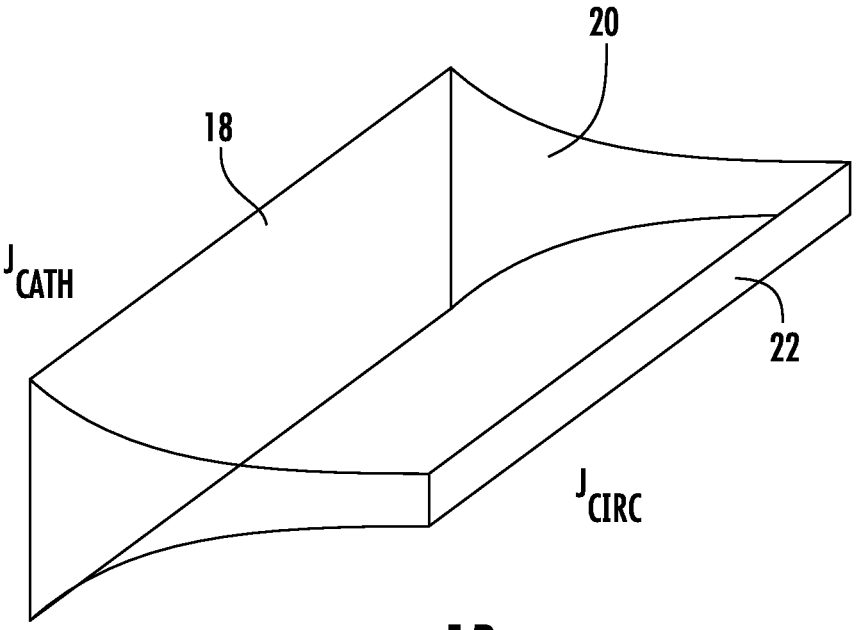

FIG. 1 made up of FIG. 1A and FIG. 1B is a schematic illustration of two examples of electron beam compression. In FIG. 1A two dimensional compression of a circular electron beam is illustrated. At 10, the electron beam 12 emitted from a cathode is compressed by a magnetic field (not shown) to produce an electron beam having smaller diameter and higher current density at the point where it enters the circuit present at 14 (the circuit end of the electron beam). This illustrates that a factor of ten in compression may result in a factor of 100 increase in the current density at the circuit relative to that of the cathode. For example using a round cathode configuration, if the beam 12 is compressed by a factor of 10 and a current density at the cathode $J_{cath}$ is 10 Å/cm$^2$, the resulting output (e.g., the output to a circuit) $J_{circ}$ at 14 is approximately 1000 A/cm$^2$.

FIG. 1B depicts in a schematic illustration one dimensional compression of a sheet beam in which a factor of ten in compression may result in a factor of ten increase in the current density at the circuit relative to that of the cathode. In FIG. 1B, for example using a rectangular cathode configuration at 18, an increase in current density of the electron beam 20 can be provided for an input of $J_{cath}$=100 A/cm2 resulting in an output of Jcirc=1000 A/cm2 at 22.

Plasma cathodes can be designed to provide electrons in a single or multiple beams, a round or shaped beam, a sheet or linear array beam to the desired beam size, geometry and aspect ratio without limitation. Plasma cathodes are well suited to generate electron sheet beams which are attractive because they can be geometrically tailored to match the aperture of a slow wave structure so that electrons are introduced preferentially into the beam tunnel of the slow wave circuit minimizing beam losses to adjacent surfaces. Loss of electrons as a result of interaction of the electron beam with adjacent surfaces is usually referred to as beam scrape-off or beam scrapping which is undesirable not only due to the loss of electrons but also the associated localized heating. The advantage of a sheet beam generated by a plasma cathode increases with increasing frequency of operation because the dimensions of the beam tunnel and the slow wave structure scale as the wavelength λ. In a pencil-beam device, the beam diameter must be approximately λ/10 or less. Space-charge forces fundamentally limit the current that can be transported in such a small diameter beam thus limiting the power that can be generated.

Sheet beams also enable higher power with smaller permanent magnets. Integral bar or sheet magnets may be used for beam focusing and confinement. For example, a permanent magnet solenoid may be used to magnetically confine the electron beam as it passes through the beam tunnel within the slow wave structure.

As illustrated in FIG. 1, two-dimensional compression in the case of a circular beam and one-dimensional compression in the case of a sheet beam may be used to increase the current density at the circuit by as much as 100 times and 10 times, respectively in the examples shown to illustrate the concept. Compression to a lesser degree or to slightly greater degree may be achieved by providing lessor or greater magnetic fields. Experimental current densities to greater than 10 A per square centimeter have been achieved at atmospheric pressure in uniform discharges of a wide variety of gases depending upon the cathode-grid spacing and applied electric potential. Assuming one dimensional or two dimensional compression of the magnitude illustrated for example in FIG. 1 using a magnetic field much higher current densities in the beam may be achieved as it enters the electron beam tunnel within a slow wave structure or other interaction region. Plasma generation resulting in the presence of ions in the beam channel will aid in the confinement of the electron beam as a result of reduction in beam space charge and allow operation of these devices at currents larger than the space-charge limiting current in the absence of the plasma. Reduction of space charge effects also permits a reduction of the magnetic field required to compress the electron beam [Dan M. Goebel, Yuval Carmel, and Gregory S. Nusinovich, "Advances in plasma-filled microwave sources", Phys. Plasmas 6, 2225 (1999)]. Small changes in the beam size due to the presence of ions can have an effect on the coupling of the beam to the interaction structure and the RF output power of the tube due to small changes in their relative displacement and should be considered in the design. The average kinetic energy of electrons extracted from plasma discharge can be increased from about 1 eV, to tens of eV, to hundreds of eV or to higher kinetic energy (run away electrons) by increasing the voltage applied between the electron gun and collector or cathode and collector. This allows one to select the velocity of the electrons in order to match the velocity of the electron beam with the velocity of the propagating RF wave.

Plasmas have been formed at atmospheric pressure in many different gases including air, $N_2$, Ar, He, $H_2$, $NH_3$, $O_2$, $CO_2$, $CH_4$, $CF_4$, and $SF_6$ and gas mixtures. For the purpose of forming an integrated pressurized electronic power amplifier circuit, any gases may be used although an inert gas or inert gas mixture is preferred such that reactive ions are not generated in the discharge which would form reaction products such as, for example, surface oxides with metal parts in the case of the presence of $O_2$. Various gases and gas mixtures at different concentrations may be used to influence the breakdown potential and degree of ionization in the discharge. Under certain experimental conditions for example, with addition of argon, the breakdown voltage at a fixed pressure and electrode gap initially decreases by a small, but finite amount, from 142 V in pure helium to 137 V with the addition of 0.08% of argon. Further addition of argon, however, increases the breakdown voltage substantially, up to 170 V for 5% argon in the gas mixture. In comparison, addition of nitrogen or oxygen yields no discernible initial decrease in the breakdown voltage and the breakdown voltage increases very rapidly when a substantial fraction of oxygen or nitrogen is added to the helium. For example, the breakdown voltage increases to 357 V for a 3% oxygen mixture and to 302 V for a 3% nitrogen mixture [Park, et al., J. Appl. Phys. 89, 15 (2001)].

Requirements for gas purity for plasma cathodes are relaxed relative to that of vacuum devices in light of the fact that there is no hot cathode with reactive or low work function surfaces although the breakdown voltage, degree of ionization and the lifetime of ions and excited species may influence gas selection and purity. As a result the need for extensive pumping and RF heating of metal parts prior to sealing the tube envelope and the need for getters once the tube is sealed are diminished although the steps may still be employed prior to filling the vacuum envelope with the desired gas/gas mixture to the desired pressure. This can lower the production costs of pressurized electronic power amplifier circuits relative to the production costs of vacuum tubes. Minimization of the requirement for an envelope around the beam stick capable of maintaining the highest vacuum integrity throughout the lifetime of the device allows construction of less expensive and lighter weight devices. However, a sealed envelope around the beam stick with no leaks is still desirable and may be required for certain applications. Lighter weight devices would be advantageous for space and airborne applications. However, due to the lower pressure ambient outside the tube when devices are deployed at upper atmosphere or in space, the envelope surrounding the beam stick should maintain the pressurized ambient inside the tube at the specified pressure. This permits the plasma cathode to continue to operate within the design specifications.

Application of an electric field between the cathode and the grid sufficient to cause breakdown in the gas is provided to generate a plasma. As the pressure increases the breakdown voltage increases for a fixed electrode gap following a trend known in the field as the Paschen Curve. Non-uniform or filamentary discharges are typical of plasmas as the pressure is increased toward atmospheric pressure. The filaments, also called streamers or micro-discharges, represent high current regions within the plasma. A uniform or homogeneous discharge is preferred although filamentary or micro-discharges discharges may be useful as a source of electrons in some applications such as when the filaments are closely spaced and uniformly distributed [Ulrich Kogelschatz, "Filamentary, Patterned, and Diffuse Barrier Discharges", IEEE Transactions on Plasma Science, Vol. 30, No. 4 (2002) 1400]. Repulsion between micro-discharges leads to the formation of short-range order that in some cases results in self-organization of the micro-discharges into regular patterns. Compression of closely spaced and uniformly distributed micro-discharges using a magnetic field is one method of generating a more uniform electron beam as a plasma cathode for use in an integrated atmospheric pressure electronic amplifier circuit device.

Homogeneous discharges, which may include glow or glow-like discharges [Francoise Massines, Christian Sarra-Bournet, Fiorenza Fanelli, Nicolas Naude, Nicolas Gherardi, "Atmospheric Pressure Low Temperature Direct Plasma Technology: Status and Challenges for Thin Film Deposition", Plasma Process. Polym. 9 (2012) 1041-1073], are generated using a variety of approaches even at atmospheric pressure. It is possible to suppress streamers by short (≤10 ns) pulses, where arcs do not have sufficient time to develop. To avoid the transition of the discharge into an arc or spark in the absence of a dielectric barrier, the discharge may also be driven at high frequency RF voltages such that the plasma generated species cannot follow the oscillations of the excitation source [D. W. Liu, J. J. Shi, and M. G. Kong, "Electron trapping in radio-frequency atmospheric-pressure glow discharges", Applied Physics Letters 90 (2007) 041502]. The use of a dielectric barrier over one or both electrodes, referred to as a dielectric barrier discharge (DBD), and the use of special voltage conditions are utilized to generate uniform discharges. The presence of the dielectric in the gap limits arc formation. The dielectric barrier can be made from glass, quartz, ceramics, or polymers; materials of high breakdown strength. In all DBDs, the dielectric accumulates surface charge which is dissipated between voltage pulses, through the use of bipolar pulses, or other techniques. There are a large number of different designs, constructions, dielectric barriers and voltage waveforms used in DBD formation. So, there are a variety of techniques to generate DBD-based plasma cathodes for use in integrated atmospheric pressure electronic circuit devices.

Voltage, electrode gap, dielectric barrier material, gas or gas mixture, pressure, voltage ramp rate, and applied pulse repetition frequency are the important adjustable parameters influencing the formation of a homogeneous DBD. Among the most important adjustable parameters is pressure. Plasmas for the purpose of serving as a source of electrons for an integrated pressurized electronic power amplifier circuit as described herein may be formed at pressures ranging from approximately 100 Torr or slightly below to about one atmosphere or slightly above one atmosphere. In certain embodiments, the pressure can range from about 500 Torr to about 1 atmosphere or somewhat above as discussed previously. Electrons generated in a discharge of the gas provided in the envelope of the pressurized electronic power amplifier circuit device at the lower end of this pressure range have a longer mean free path between collisions with gas atoms or molecules than electrons generated in a discharge at the upper end of this pressure range. The longer mean free path of electrons at the lower pressure range allows the design of an integrated pressurized electronic power amplifier circuit with a slow wave structure of greater length. As the pressure increases, the collision frequency between electrons and gas atoms or molecules increases. Depending upon the voltage, voltage rise time, frequency and wave form, unstable or filamentary discharges may be prevalent as the pressure increases above approximately one atmosphere.

A uniform high current density discharge is preferred in order to generate a uniform high electron density beam. Uniform discharges have been achieved at atmospheric pressure using techniques described in U.S. Provisional Patent Application 61/494,201 and in U.S. Pat. Nos. 7,615,931; 7,615,933; 8,084,947 and 8,344,627 to Hooke, et al., each of which are hereby incorporated by reference. At atmospheric pressure uniform discharges have been achieved at electrode gaps of the order of 5 mm at 20 kV. Uniform discharges may be achieved at correspondingly much larger gaps between the cathode and grid when the applied electromagnetic field is increased. As the electron kinetic energy is converted to energy of a propagating electromagnetic wave as the electron beam passes through the device in relative proximity to the RF circuit, the electron path length determines among other things the power which can be produced.

A variety of electronic driving functions can be used to generate the discharge of the plasma cathode. DBDs are generated by ac power sources of tens of Hz, tens of kHz, tens of MHz, or radio-frequency of periodic sine or square waves. DBDs are also driven by unipolar and bipolar pulsed voltages of a wide range of frequencies and risetimes. Power generators vary widely in performance and different results are expected from using various power generators and discharge configurations. Among currently available power supplies tens to hundreds of kW of power in atmospheric pressure plasmas can be generated. These include the inductive energy storage type based on magnetic pulse compression and solid-state switched generators and capacitive energy storage and spark gap or thyratron switched generators. Both of these approaches utilize fast rise-time voltages which results in an over-voltage condition prior to breakdown of the gas. The breakdown voltage using a fast rise time pulse can exceed that of using an ac or a dc source by two to three times or greater. An over-voltage will result in a higher initial electric field, higher discharge current and greater instantaneous power but the average power may still be low. Increasing the pulse frequency will increase the duty cycle and the average power. Charged particle densities of $>10^{15}/cm^3$ have been achieved. A difference between the two power supplies is the pulse duration.

Shao et al [Tao Shao, Yang Yu, Cheng Zhang, Dongdong Zhang, Zheng Niu, Jue Wang, Ping Yan and Yuanxiang Zhou, "Excitation of Atmospheric Pressure Uniform Dielectric Barrier Discharge Using Repetitive Unipolar Nanosecond-pulse Generator", IEEE Transactions on Dielectrics and Electrical Insulation Vol 17, No 6, (2010) 1830] utilize a nanosecond-pulse DBD produced by repetitive unipolar nanosecond pulses with a rise time of 40 ns and a full-width at half-maximum of 70 ns. The other plasma generation system shown in U.S. Pat. Nos. 7,615,931; 7,615,933; 8,084,947 and 8,344,627 to Hooke et al., which are hereby incorporated by reference, utilize <70 ns rise times with adjustable current pulse width of 70 to 250 ns. Both power supplies provide high-voltage pulses of greater than 25 kV. Higher voltage pulsed power supplies have been generated. Plasma can also be generated using a self-tuning power supply at atmospheric pressures using techniques described in U.S. Provisional Patent Application 61/494,201 filed Jun. 7, 2011 and PCT application PCT/US20012/041103 filed on Jun. 6, 2012 to Hooke et al claiming priority thereto, both of which are hereby incorporated by reference. A power supply meeting the specifications of the PCT application filed on Jun. 6, 2012 to Hooke et al has delivered 4 kW of CW power. Additional atmospheric pressure plasma generation approaches are described in the following two review articles: L. Bárdos and H. Baránková, "Cold atmospheric plasma: Sources, processes, and applications", Thin Solid Films 518 (2010) 6705-6713; and Francoise Massines, Christian Sarra-Bournet, Fiorenza Fanelli, Nicolas Naude, Nicolas Gherardi, "Atmospheric Pressure Low Temperature Direct Plasma Technology: Status and Challenges for Thin Film Deposition", Plasma Process. Polym. 9 (2012) 1041-1073.

Figure 2:
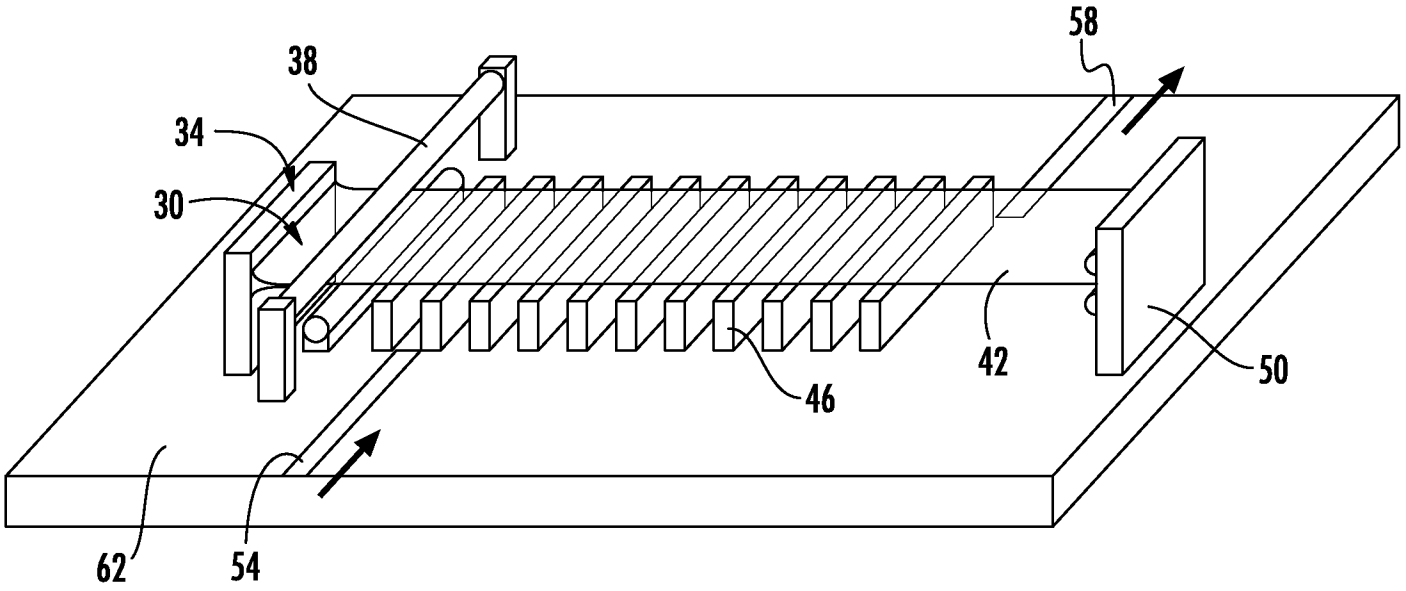
FIG. 2 is a schematic of an example integrated pressurized electronic amplifier circuit device consistent with certain embodiments of the present invention.

FIG. 2 is an illustrative example schematic showing components of a pressurized electronic amplifier circuit device consistent with certain implementations consistent with the present invention. In this illustrated example, a plasma 30 is generated between a cathode 34 and an electron gun structure 38 to form a sheet beam 42 which passes in proximity to a slow wave structure 46 (serving as an interaction structure) to a beam collector 50. The slow wave structure serves to propagate the RF wave along the tube at approximately the same velocity as that of the electron beam. Interactions with the RF wave cause the electron beam to bunch, which in turn amplifies the RF wave traveling down the tube. The RF input line and RF output line of this implementation are essentially RF strip-lines or other RF transmission lines (coaxial, waveguides, etc. or other suitable connection). These components are mounted on a supporting substrate 62 such as a ceramic substrate which may also be configured to contribute to thermal management by use of appropriate thermally conductive materials, by coating the substrate with thermally conductive materials or affixing thermally conductive structures thereto.

The surrounding beam stick envelope and magnetic device are not shown in this illustration. The device as shown includes a plasma cathode 34, electron gun 38, electron beam 42, slow wave structure 46, beam collector 50, and supporting substrate 62 as well as input and output lines 54 and 58. An enveloped surrounding the beam stick seals the pressurized device. In addition no specific thermal management materials or structures are explicitly depicted and no first stage driver circuit shown although use of these materials, structures and circuits may be deployed as needed. Other arrangements of these elements are possible.

Vacuum electronic power amplifiers, vacuum electronic devices or vacuum tubes contain common components which are also the common components necessary to produce an integrated pressurized power amplifier circuit and which are described here. The physics of these components and the role they play in electronic power amplifiers as well as the various designs and selection for various applications are discussed in great detail in the literature. The text by A. S. Gilmour, Jr. [A. S. Gilmour, Jr, Principles of Traveling Wave Tubes, Artech House, Boston, Mass., 1994] and the text edited by Robert J. Barker, John H. Booske, Neville C. Luhmann, Jr. and Gregory S. Nusinovich [Robert J. Barker, John H. Booske, Neville C. Luhmann, Jr. and Gregory S. Nusinovich, Modern Microwave and Millimeter-Wave Power Electronics, IEEE Press, Piscataway, N. J., 2005] as well as other texts provide comprehensive reviews of the principles of traveling wave tubes and power electronics and the selection, design and performance of the key components.

As used herein "cathode" refers to a source of electrons which is usually accompanied by a grid(s) (not shown, but which can be an aperture in the electron gun or a physical grid or grids mounted close to the electron gun structure) or extraction electrode to extract electrons. An electron gun structure serves to focus, deflect or accelerate the electrons. The electrons pass through a beam tunnel which is an open region which allows the electrons to pass unimpeded from the electron gun to the beam collector. The beam collector is a structure to collect the spent electron beam and it is usually accompanied by a circuit designed to collect and recycle the energy in the spent electron beam. An RF input line is used to guide electromagnetic radiation to an interaction structure (e.g., a slow wave structure) and the RF output line is used to guide the electromagnetic radiation away from the interaction structure and out of the tube. A slow wave structure (or other interaction structure) guides an electromagnetic wave along the direction of and in parallel with the electron beam. The slow wave structure and electron beam are placed in proximity to each other so that the electrons interact with the longitudinal electric field components of the guided wave. Alternatively, fast wave structures may be used instead of slow wave structures as an interaction structure in which the electrons interact with the traverse electric field components of the guided wave. The interaction between the electron beam and electromagnetic wave (in both slow wave structures and fast wave structures) allows the transfer of kinetic energy from the electrons to the electromagnetic wave thus amplifying the power of the electromagnetic wave. Any suitable slow wave or fast wave structure can be adapted for use as an interaction structure without departing from the teachings herein.

In a traveling wave tube mode of operation both the electromagnetic wave and electron beam are propagating in the forward direction. In a backward wave oscillator mode of operation the traveling electromagnetic wave is propagated backwards in the opposite direction of the electron beam. Power amplification of a wide range of frequencies of the electromagnetic spectrum can be achieved depending upon the wavelength of the radiation and the velocity of the electrons. Although there are precise definitions delineating the frequency regimes of the electromagnetic spectrum from the microwave to the terahertz regimes, it is common practice to refer to this type of power amplifiers as an RF or microwave power amplifier.

Due to the tight alignment tolerances between components, a highly polished planar surface may be utilized upon which to integrate the components of the amplifier device. Other integration methods may be used which do not utilize a planar substrate. As a result of the excessive amount of heat generated as a result of high power operation of many devices, the substrate upon which the circuit is integrated is preferably composed of thermally conductive materials or has a thermally conductive coating such as diamond deposited by chemical vapor deposition or has an attached thermal element. The substrate acts like a heat spreader dispersing and dissipating heat so that no portion of the integrated structure experience excessive thermal excursions. Other heat dispersing and dissipating techniques are employed when integration of the device does not involve a planar substrate common to all the major components including cooling methods such as microchannel coolers, heat pipes, foam-based cold plates, diamond structures, graphite structures and others.

Overall dimensions between the cathode and grid are on the order of between about 100 micrometers or less and about 5 millimeters or more. Depending upon the applied electromagnetic potential, electrons generated by the discharge formed between cathode 34 and grid of the plasma cathode (in this example, the electron gun) can be accelerated by means of an electron gun 38 (or other suitable electron accelerating structure) past the slow wave structure 46 (or other suitable interaction structure) to the collector 50. Known methods of the use of lenses, deflection plates, accelerating structures and magnetic fields can be used to focus, deflect and shape the beam for optimal interaction with the slow wave structure 46 to produce the desired operational parameters.

Known methods of fabrication allow the production of interaction structures such as slow wave structure 46 with dimensions and aspect ratio within a specified tolerance and surface smoothness to produce target electromagnetic characteristics in terms of frequency, transmission/reflection and dispersion/resonance over a wide frequency range. The upper limit of the length of the slow wave structure 46 depends upon the electron beam path length among other things which is determined by the potential between the electron gun 38 and collector 50 and pressure among other things. At certain conditions an example length of the slow wave structure 46 could be 5 mm while at other conditions it may be more than 20 mm. The plasma cathode 34 can generate a number of different beam shapes including long sought sheet electron beams.

Figure 3:
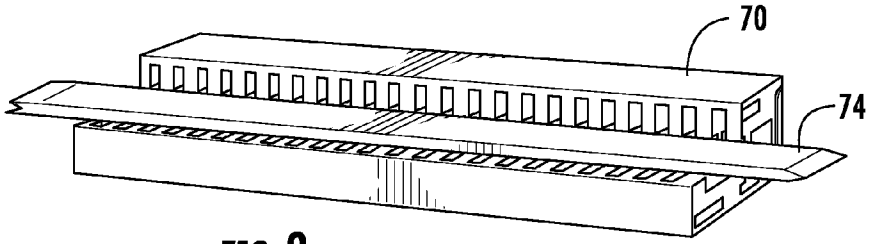
FIG. 3 is a cutaway schematic view of an example extended slow wave interaction structure consistent with certain embodiments of the present invention.

FIG. 3 shows a schematic cut-away section of an example slow wave structure 70 showing a sheet beam of electrons 74 of a coupled cavity traveling wave structure. The performance of the integrated pressurized electronic power amplifier circuit device depends in part upon the beam aspect ratio and proximity of the electron beam 74 to the elements of the slow wave structure 74 as well as the overall interaction length. The electron beam can be collinear with the slow wave structure or can traverse the slow wave structure.

Figure 4:
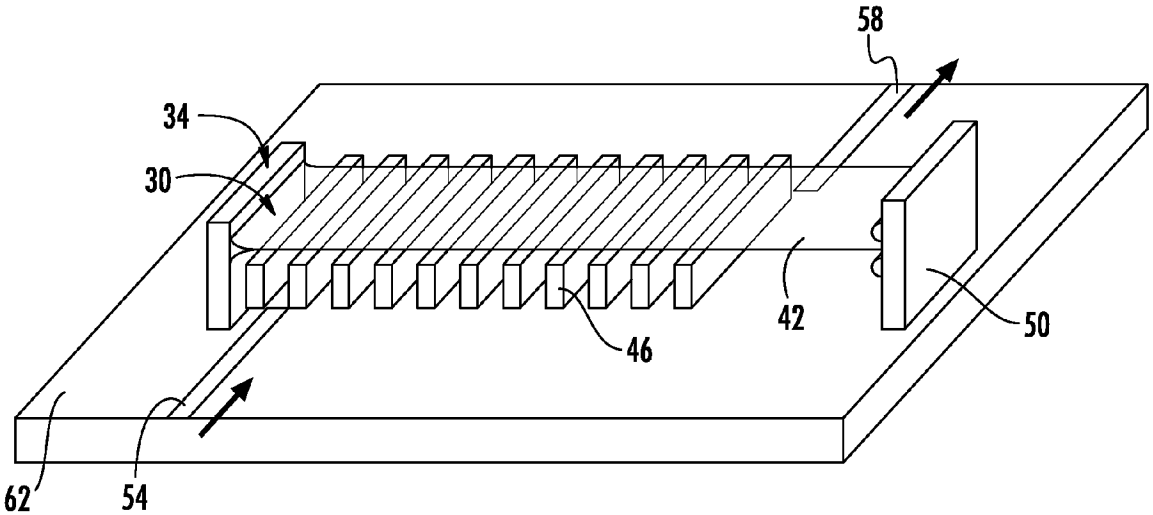
FIG. 4 is a schematic of an example integrated pressurized electronic amplifier circuit device consistent with certain embodiments of the present invention.

FIG. 4 depicts a schematic of an example integrated pressurized electronic amplifier device suitable for high power applications and showing the generation of a plasma 30 between a cathode 34 and collector 50 forming a sheet electron beam 42 which passes in proximity to the slow wave structure 46 to the collector 50. The illustration also shows an RF input line 54 and RF output line 58. These components are mounted on a support structure 62 or substrate which may also contribute to thermal management. The device is encapsulated within a surrounding beam stick envelope that seals the pressurized device. Magnetic devices may be deployed in any suitable configuration to focus or shape the electron beam (not shown in this illustration but depicted later).

FIG. 4 is an illustrative example schematic showing components of an integrated pressurized electronic power amplifier circuit device where in contrast to the schematic in FIG. 2 there is no separate plasma cathode or electron gun structure. While no specific thermal management materials or structures or driver circuit are depicted, these materials, structures and circuits may be deployed as needed for the specific application. A plasma discharge is formed as a result of the application of an electromagnetic potential suitable to produce a plasma between the cathode 34 and the collector 50. The plasma is formed in the electron beam tunnel of the slow wave structure 46 and the electrons are accelerated across the gap to the collector 50 as a result of collector bias as well as coupling of the electromagnetic wave traveling in the slow wave structure with the electrons in the beam. Since the cathode 34 may be planar as shown in FIG. 4 (although other beam shapes may be deployed), it can be produced at dimensions to match an aperture of the electron beam tunnel within the slow wave structure 46. The elimination of a separate plasma cathode and electron gun structure allows the formation of more compact integrated pressurized electronic power amplifier circuit devices. However, it eliminates the potential for beam compression prior to the beam 42 entering the slow wave structure 46 which could be used to increase the electron beam current density.

The examples in FIGS. 2 and 4 are schematics of integrated pressurized electronic power amplifier where the overall dimensions are small enough for the electrons to travel from the cathode 34 to the electron gun structure 38, from the electron gun structure 38 to the collector 50 or from the cathode 34 to the collector 50 without significant scattering. However, amplifier designs such as traveling wave tubes often rely on the electron beam traveling longer distances with correspondingly larger slow wave structure dimensions. At internal pressures in the range of atmospheric pressure, electron scattering over the length of the larger slow wave structures would diminish the performance of the amplifier. A sheet beam or linear array of electrons beams can be formed along the length of and in parallel with the interaction structure by providing suitable electrodes along the edges of and perpendicular to the slow wave structure such that the plasma is formed within the interaction structure and a uniform sheet of electrons is formed which is transverse the longitudinal direction of the slow wave structure. Uniform discharge formation has been achieved for electrode pairs separated by approximately 2 mm of up to 1 meter in length with total discharge currents of greater than 1000 A. The transverse grouping of a uniformly charged electron beam drifting in a longitudinal magnetic field over comes the problems arising from the nonlinear Coulomb forces that usually play a role in the formation of electron bunches and in the energy exchange between them and the external electromagnetic field of traditional longitudinal vacuum electronic devices [V A Vanke, "Transverse electron-beam waves for microwave electronics", Physics—Uspekhi 48 (9) 917-937 (2005)].

Thus, implementations consistent with the present invention advance the art of integrated power amplifier circuit devices through the use of a pressurized electronic circuit which makes use of a plasma discharge of the gas within the tube as a source of electrons as a rugged cold cathode. In different embodiments, controlled wideband modulation, high gain, RF transmission, phase and polarization control can be achieved. Operation at atmospheric pressure allows construction of simple, light weight high power amplifier circuits which are less susceptible to air leaks and out-gassing. Cold plasma cathodes consume less energy than thermionic cathodes improving the energy efficiency of amplifiers. While atmospheric discharges have certain benefits as described, discharges at other pressures can use similar techniques without limitation.

Figure 5:
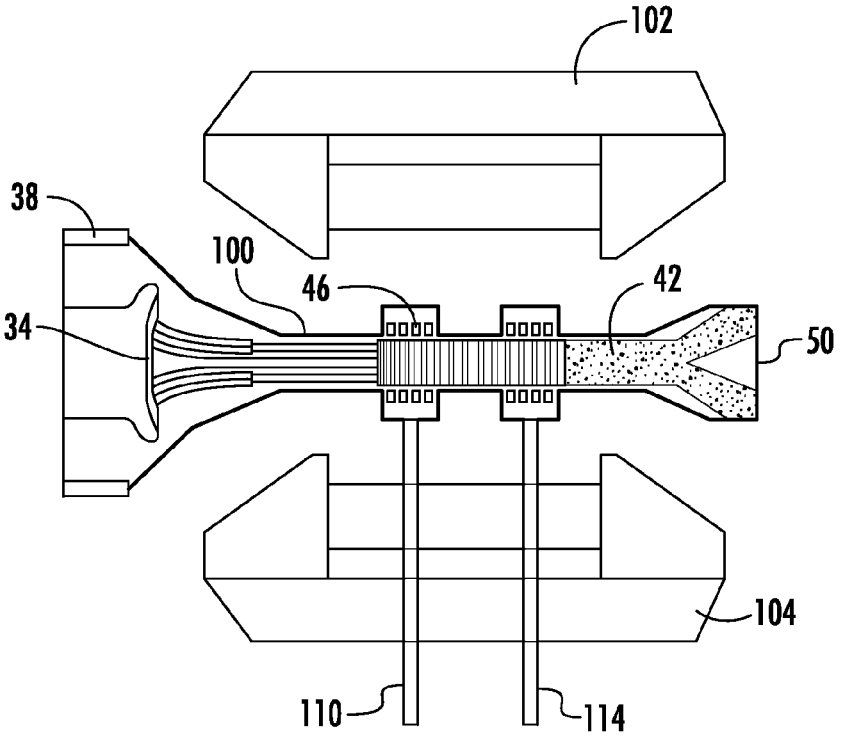
FIG. 5 is a schematic of an example integrated pressurized envelope and magnetic structure consistent with certain embodiments of the present invention.

Referring now to FIG. 5, another image of an example electronic device consistent with certain implementations is depicted in schematic form. In this example, envelope 100 is depicted as surrounding the beam stick and further depicts one example arrangement of permanent magnets 102 and 104 which aid in compressing the electron beam to minimize the interaction of the beam with the structures surrounding the beam tunnel. In this example, input is provided via an input waveguide 110 and the output is taken at output waveguide 114. The compression is aimed at preventing the beam from expanding as a result of electron repulsion and intersecting the walls of the beam tunnel.

Space charge forces are so high for the typical current density of electron beams of power amplifier circuits that rapid divergence of the beam occurs in the absence of any focusing force. The focusing force is provided by a magnetic field aligned with the axis of the electron beam. The magnetic field can be generated by a solenoid in the example shown in FIG. 5. The electrons experience a magnetic force toward the axis.

Figure 6:
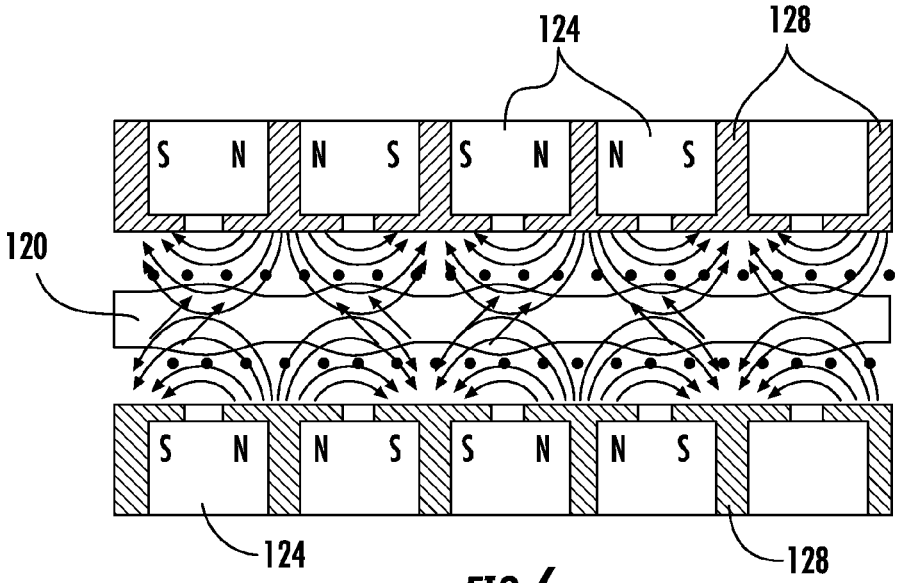
FIG. 6 is a schematic of an example periodic cusp magnet structure consistent with certain implementation of the present invention.

Alternatively, periodic permanent magnets as shown in FIG. 6 can be utilized in focusing the electron beam when it is desirable to reduce the size and weight of a power amplifier circuit. The electron beam is shown as 120 passing between an array of magnetic sections 124 shown with alternating polarity and separated by magnetic poles such as 128. As an electron beam enters the magnetic field of one of the magnetic sections, the force on the electrons cause the electrons to rotate and the interaction of the resulting rotational motion with the axial field produces a radial force that serves to compress the beam. As the beam leaves the magnet section, rotation stops and the focusing forces vanish. The beam then expands under the space charge forces. As the beam traverses the alternating fields of the periodic magnet structures, the beam oscillates back and forth while undergoing alternating periods of magnetic focusing and beam expansion.

Figure 7:
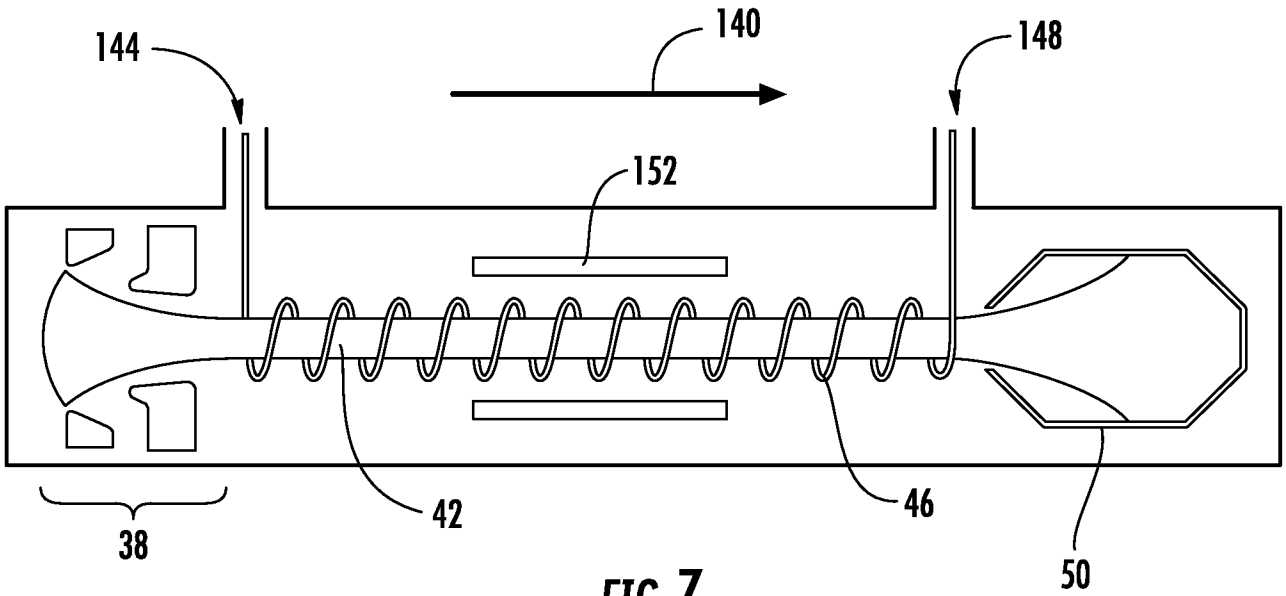
FIG. 7 illustrates an example of a helix traveling wave tube consistent with certain implementations of the present invention.

FIG. 7 depicts an example of a helix traveling wave tube. In this example, magnetic forces are depicted by arrow 140 and attenuators 152 are provided on each side of the electron beam 42. RF input is provided at input 144 and output is taken at 148. The slow wave interaction structure in this example is in the form of a helix 46.

The helix, employing a helix slow wave structure 46, and coupled cavity traveling wave tubes are the two basic types which in spite of their differences operate on the same or similar principles. The helix traveling wave tube as shown illustrates the helix 46 surrounding the electron beam 42. The electric field inside the helix 46 possesses large axial components. When an electron beam is injected along the axis of the helix, the axial electric field components accelerate some electrons and decelerate others. This causes the electrons to bunch up. As the electron beam-wave interaction continues, the induced waveform on the helix becomes much larger than the initial waveform.

Thus, in certain implementations, an integrated pressurized electronic power amplifier circuit has a plasma cathode structure and beam focusing approach leading to an electron beam, an interaction region; an input signal line (e.g., a transmission line, stripline, waveguide, coaxial cable, etc. or other suitable connection) for conducting an input signal into the interaction region; an output signal line for conducting an output signal from the interaction region; a collector for the electron beam; and an envelope for maintaining a pressurized ambient and a substrate for selected spatial alignment and thermal management; and wherein the plasma cathode structure generates a plasma as a source of electrons.

In certain implementations, the device serves as an amplifier or oscillator intended for electromagnetic radiation reception, generation and re-transmission of electrical signals, both tuned and broadband. In certain implementations, the device is operated as a traveling wave amplifier tube. In certain implementations, the device is operated as an oscillator. In certain implementations, the device is operated as a backward wave oscillator. In certain implementations, the device is operated as an electrical signal coupler. In certain implementations, the pressurized envelope comprises a gas or mixture of gases. In certain implementations, the pressure inside the envelope surrounding the device is approximately one atmosphere; in certain implementations, the pressure inside the envelope is greater than approximately 500 Torr; in certain implementations, the pressure inside the envelope is greater than approximately 100 Torr or in any sub-range of the above pressures. In certain implementations, the plasma cathode is based upon a discharge of the gas present within the envelope of the device. In certain implementations, the plasma is uniform or filamentary. In certain implementations, the average electron energy is selected by selecting the bias potential between the cathode and grid, electron gun and collector or cathode and collector.

In certain implementations, the plasma cathode is designed to provide electrons in a single or multiple beams, round or shaped beam, a sheet or a linear array beam. In certain implementations, the device is provided with one or more than one magnetic field generator for focusing the electron beam. In certain implementations, the ions present in the beam tunnel within the slow wave structure are produced by the plasma cathode generating a focused electron beam. In certain implementations, the device generally contains the basic components of a cathode structure, an input structure, an interaction structure, an output structure and a collector structure which may be arranged in various combinations to produce successive amplifications, frequency multipliers, transmit-receive amplifiers, crossbar switches, mixers, beamformers, and selective polarization devices, among other such devices. In certain implementations, the device is used to produce gridded tubes, klystrons, traveling wave tubes, backward wave oscillators, crossed-field amplifiers, magnetrons and gyrotrons. In certain implementations, the electron beam is collinear with the slow wave structure. In certain implementations, the electron beam or beams traverse the slow wave structure.

An amplifier device consistent with certain implementations has a plasma cathode structure configured to generate an electron beam. An electron beam collector is provided and an interaction structure is disposed between the plasma cathode structure and the electron beam collector, where the electron beam collector is configured to collect an electron beam emanating from the plasma cathode structure focused on the electron beam collector and interacting with the electromagnetic radiation passing from the input to the output of the interaction structure. An input signal line is configured to conduct an input signal into the interaction structure and an output signal line is configured to conduct an output signal from the interaction structure. An envelope surrounds the plasma cathode structure, the electron beam collector, and the interaction structure surrounding the electron beam. The envelope is configured to maintain a selected ambient pressure within. The plasma cathode structure is configured to generate the plasma as a source of electrons to form the electron beam.

In certain embodiments, the amplifier device further has a substrate coupled to the plasma cathode structure, the electron beam collector, the interaction structure, the input signal line and the output signal line to maintain spatial alignment thereof. In certain embodiments, the substrate is thermally conductive to provide for thermal management of the amplifier device. In certain embodiments, the amplifier device is configured to operate as a radio frequency power amplifier or a radio frequency oscillator or a traveling wave amplifier circuit or a backward wave oscillator or an electrical signal coupler. These arrangements are configured by use of the amplifier device described herein in place of more conventional amplifier devices.

In certain embodiments, the pressurized envelope contains a gas or a mixture of gases. In certain embodiments, the pressure inside the envelope surrounding the device is approximately one atmosphere. In certain embodiments, the pressure inside the envelope is greater than approximately 500 Torr. In certain embodiments, the pressure inside the envelope is greater than approximately 100 Torr. In certain embodiments, the plasma generated is generated by a discharge of the gas or mixture of gasses present within the envelope of the device. In certain embodiments, the plasma is either uniform or filamentary. In certain embodiments, average electron energy delivered to the electron gun is selected by selecting a bias potential between the cathode and a grid. In certain embodiments, an electron gun is configured to focus and deflect the electron beam. In certain embodiments, average electron energy in the electron beam is selected by selecting a bias potential between the electron gun and the collector. In certain embodiments, average electron energy in the electron beam is selected by selecting a bias potential between the plasma cathode and the collector. In certain embodiments, the plasma cathode is configured to provide a plurality of electron beams. In certain embodiments, the plasma cathode is configured to provide a round beam, a shaped beam, a sheet beam or a linear array beam. In certain embodiments, one or more magnetic field generators are configured to focus the electron beam. In certain embodiments, the interaction structure comprises a slow wave structure. In certain embodiments, ions produced by the plasma cathode are present in an electron beam tunnel, and where the ions focus the electron beam. In certain embodiments, the electron beam is collinear with the slow wave structure. In certain embodiments, the electron beam traverses the slow wave structure.

An amplifier device consistent with certain implementations has a plasma cathode structure configured to produce plasma as a source of electrons for the formation of an electron beam directed toward an electron beam collector. A slow wave structure disposed between the plasma cathode structure and the electron beam collector, where the electron beam collector is configured to collect an electron beam emanating from the plasma cathode structure focused on the electron beam collector with the electron beam interacting with the slow wave structure. One or more magnetic field generators is configured to focus the electron beam. An input signal line is configured to conduct an input signal into the slow wave structure. An output signal line is configured to conduct an output signal from the slow wave structure. A substrate is coupled to the plasma cathode structure, the electron beam collector, the interaction structure, the input signal line and the output signal line to maintain spatial alignment thereof. An envelope surrounds the plasma cathode structure, the electron beam collector, the interaction structure, where the envelope is configured to maintain a pressurized gas or mixture of gasses at an ambient pressure selected within the range of about 100 Torr and 760 Torr. The plasma cathode structure is configured to generate a plasma as a source of electrons to form the electron beam.

Another amplifier device has a plasma cathode structure configured to generate a plasma as a source of electrons to form an electron beam directed at an electron beam collector. An interaction structure has an input and an output and being disposed between the plasma cathode structure and the electron beam collector in a manner that allows the electron beam to interact with electromagnetic radiation passing from the input to the output of the interaction structure. An envelope surrounds the plasma cathode structure, the electron beam collector and the interaction structure, where the envelope is configured to maintain a selected ambient pressure between approximately 100 Torr and approximately one atmosphere within.

The amplifier devices as discussed herein usually contain the basic components of a cathode structure, an input structure, an interaction structure, and an output structure and a collector structure which may be arranged in various combinations to produce successive amplifications, frequency multipliers, transmit-receive amplifiers, crossbar switches, mixers, beamformers, and selective polarization devices, among other such devices. The amplifier devices can be used to produce gridded tubes, klystrons, traveling wave tubes, backward wave oscillators, crossed-field amplifiers, magnetrons and gyrotrons.

While certain illustrative embodiments have been described, it is evident that many alternatives, modifications, permutations and variations will become apparent to those skilled in the art in light of the foregoing description.

What is claimed is:

1. An amplifier device comprising:

a plasma cathode structure configured to generate a plasma as a source of electrons to form an electron beam;

an electron beam collector;

an interaction structure disposed between the plasma cathode structure and the electron beam collector;

an input signal line configured to conduct an input signal into the interaction structure;

an output signal line configured to conduct an output signal from the interaction structure;

where the electron beam collector is configured to collect the electron beam emanating from the plasma cathode structure focused on the electron beam collector and interacting with the electromagnetic radiation passing from the input signal line to the output signal line of the interaction structure;

an envelope surrounding the plasma cathode structure the electron beam collector and the interaction structure; and where the envelope contains a gas at a pressure greater than 100 Torr.

2. An amplifier device comprising:

a plasma cathode structure configured to generate a plasma as a source of electrons to form an electron beam;

an electron beam collector;

an interaction structure disposed between the plasma cathode structure and the electron beam collector;

an input signal line configured to conduct an input signal into the interaction structure;

an output signal line configured to conduct an output signal from the interaction structure;

where the electron beam collector is configured to collect the electron beam emanating from the plasma cathode structure focused on the electron beam collector and interacting with the electromagnetic radiation passing from the input signal line to the output signal line of the interaction structure;

an envelope surrounding the plasma cathode structure, the electron beam collector and the interaction structure;

where the envelope is configured to maintain a selected ambient pressure within; and a substrate that is coupled to the plasma cathode structure, the electron beam collector, the interaction structure, the input signal line and the output signal line to maintain spatial alignment thereof.

3. The amplifier according to claim 2, where the substrate is thermally conductive to provide for thermal management of the amplifier device.

4. The amplifier device according to claim 1, configured to operate as a radio frequency power amplifier, a radio frequency oscillator, a traveling wave tube, a backward wave oscillator, an electrical signal coupler, a klystrons, a magnetron, a crossed-field amplifier, a gridded tube and a gyrotron.

5. The amplifier device according to claim 1, where the envelope contains a gas or a mixture of gases.

6. The amplifier device according to claim 5, where the pressure inside the envelope surrounding the device is approximately one atmosphere.

7. The amplifier device according to claim 5, where the pressure inside the envelope is greater than approximately 500 Torr.

8. The amplifier device according to claim 5, where the pressure inside the envelope is between approximately 100 Torr to approximately 760.

9. The amplifier device according to claim 5, where the plasma generated is generated by a discharge of the gas or mixture of gasses present within the envelope of the device.

10. The amplifier device according to claim 9, where the plasma is uniform.

11. The amplifier device according to claim 9, where the plasma is filamentary.

12. The amplifier device according to claim 9, where ions produced by the plasma cathode are present in an electron beam tunnel, and where the ions focus the electron beam.

13. The amplifier device according to claim 1, where average electron energy delivered to the electron gun is selected by selecting a bias potential between the cathode and a grid.

14. The amplifier device according to claim 1, further comprising an electron gun configured to focus and deflect the electron beam.

15. The amplifier device according to claim 14, where average electron energy in the electron beam is selected by selecting a bias potential between the electron gun and the collector.

16. The amplifier device according to claim 1, where average electron energy in the electron beam is selected by selecting a bias potential between the plasma cathode and the collector.

17. The amplifier device according to claim 1, where the plasma cathode is configured to provide a plurality of electron beams.

18. The amplifier device according to claim 1, where the plasma cathode is configured to provide a round beam, a shaped beam, a sheet beam or a linear array beam.

19. The amplifier device according to claim 1, further comprising one or more magnetic field generators configured to focus the electron beam.

20. The amplifier device according to claim 1, where the interaction structure comprises a slow wave structure.

21. The amplifier device according to claim 20, where the electron beam is collinear with the slow wave structure.

22. The amplifier devices according to claim 1, where the electron beam traverses the interaction structure.

23. An amplifier device comprising:

a plasma cathode structure configured to produce a plasma as a source of electrons to form an electron beam;

an electron beam collector;

a slow wave structure disposed between the plasma cathode structure and the electron beam collector;

an input signal line configured to conduct an input signal into the slow wave structure;

an output signal line configured to conduct an output signal from the slow wave structure;

where the electron beam collector is configured to collect the electron beam emanating from the plasma cathode structure focused on the electron beam collector with the electron beam interacting with the slow wave structure;

one or more magnetic field generators configured to focus the electron beam;

a substrate that is coupled to the plasma cathode structure, the electron beam collector, the interaction structure, the input signal line and the output signal line to maintain spatial alignment thereof;

an envelope surrounding the plasma cathode structure, the electron beam collector, the interaction structure; and where the envelope is configured to maintain a pressurized gas or mixture of gasses at an ambient pressure selected within the range of about 100 Torr to about 760 Torr.

24. An amplifier device comprising:

a plasma cathode structure configured to generate a plasma as a source of electrons to form an electron beam directed at an electron beam collector;

an interaction structure having an input and an output and being disposed between the plasma cathode structure and the electron beam collector in a manner that allows the electron beam to interact with electromagnetic radiation passing from the input to the output of the interaction structure;

an envelope surrounding the plasma cathode structure, the electron beam collector and the interaction structure; and where the envelope is configured to maintain a selected ambient pressure between approximately greater than 100 Torr and approximately one atmosphere within.

* * * * *